US006186757B1

(12) United States Patent
Pippes

(10) Patent No.: US 6,186,757 B1
(45) Date of Patent: Feb. 13, 2001

(54) INTERNAL-GEAR MACHINE

(75) Inventor: Reinhard Pippes, Bretten-Spranntal (DE)

(73) Assignee: Eckerle Industrie Elektronik GmbH, Malsch (DE)

( * ) Notice: Under 35 U.S.C. 154(b), the term of this patent shall be extended for 0 days.

(21) Appl. No.: 09/285,517

(22) Filed: Apr. 2, 1999

(30) Foreign Application Priority Data

Apr. 7, 1998 (DE) ..... 198 15 421

(51) Int. Cl.[7] ..... F04C 2/00
(52) U.S. Cl. ..... 418/171; 418/166; 29/888.023
(58) Field of Search ..... 418/171, 166; 29/888.023

(56) References Cited

U.S. PATENT DOCUMENTS

| | | | | |
|---|---|---|---|---|
| 1,990,750 | | 2/1935 | Pigott . | |
| 2,053,919 | | 9/1936 | Pigott . | |
| 2,650,544 | | 9/1953 | Parsons . | |
| 3,118,387 | * | 1/1964 | Aldrich | 418/166 |
| 3,327,636 | | 6/1967 | Purcell . | |
| 3,722,329 | | 3/1973 | van Hecke et al. . | |
| 3,907,470 | * | 9/1975 | Harle et al. | 418/171 |
| 4,117,025 | * | 9/1978 | Eisenmann et al. | 417/171 |
| 4,893,997 | * | 1/1990 | Eckerle | 418/171 |
| 5,618,171 | * | 4/1997 | Von Behr et al. | 418/171 |
| 5,690,481 | * | 11/1997 | Eckerle | 418/171 |
| 5,890,885 | | 4/1999 | Eckerle . | |

FOREIGN PATENT DOCUMENTS

| | | | | |
|---|---|---|---|---|
| 2606898 | * | 1/1977 | (DE) | 418/171 |
| 4421255 | * | 6/1995 | (DE) | 418/171 |
| 196 51 683 A1 | | 6/1998 | (DE) . | |
| 19651683 | * | 6/1998 | (DE) | 418/171 |
| 2213425 | * | 8/1974 | (FR) | 418/171 |
| 453044 | * | 7/1956 | (GB) | 418/171 |
| 10-213190 | * | 8/1998 | (JP) | 418/171 |

* cited by examiner

*Primary Examiner*—Thomas Denion
*Assistant Examiner*—Theresa Trieu
(74) *Attorney, Agent, or Firm*—Hoffman & Baron, LLP

(57) ABSTRACT

An internal-gear machine has a casing and a running assembly accommodated in the casing and comprising a rotatably mounted pinion and an internally toothed annular gear meshing with the pinion. The annular gear is widened at its outer periphery to form a running ring which can be integral with the internally toothed part of the annular gear or a separately produced component which is non-rotatably connected to the internally toothed part.

22 Claims, 5 Drawing Sheets

INTERNAL-GEAR MACHINE

FIELD OF THE INVENTION

The invention relates to an internal-gear machine such as a gear or pump.

BACKGROUND OF THE INVENTION

A typical form of internal-gear pump comprises a casing and a rotating unit or assembly which is accommodated therein and which comprises a rotatably mounted pinion and an internally toothed annular gear which meshes with the pinion. In such a machine the annular gear can be rotatably supported directly in a bore in the casing or in a bearing ring arranged in the bore. In other design configurations of an internal-gear machine, the annular gear is accommodated in the casing rotatably together with a running ring. A suction chamber and a pressure chamber are respectively formed between the tooth arrangements of the pinion and the annular gear, in which respect in particular the hydraulic pressure of the conveying medium, in the case of a pump, or operating medium, in the case of a motor, which prevails in the pressure chamber, determines the specific bearing loading obtaining between the outer peripheral surface of the annular gear and the bearing surface that co-operates therewith. That applies irrespective of whether the pressure chamber is respectively delimited from the suction chamber by a filling member, or whether the pressure chamber is defined by the teeth of the pinion on the one hand fully engaging into the gaps between the teeth of the annular gear and on the other hand, at a position in approximately diametrally opposite relationship with the region of engagement into the gaps between the teeth, they provide for a sealing contact with the tips of the teeth of the annular gear.

The annular gear is carried at its outer peripheral surface either in a plain bearing, in which case it is possible to set hydrostatic or hydrodynamic bearing conditions, or in a rolling bearing assembly. The permissible conveying or operating pressure of the internal-gear machine is determined by the load-bearing capability of the bearing arrangement. In the case of internal-gear machines with a low conveyor through-put, that is to say which operate at a low speed of rotation and/or which involve a tooth configuration of a small width, the conveying or operating pressure is frequently undesirably limited by the load-bearing capability of the annular gear bearing arrangement so that, in relation to the speed of rotation and/or the width of the tooth configuration, it is possibly necessary in structural terms to arrive at a compromise in order to be able to implement the required conveying or operating pressure, in a practical context.

SUMMARY OF THE INVENTION

An object of the present invention is to provide an internal-gear machine which structurally affords greater freedom in terms of the choice of the conveying or operating pressure involved.

Another object of the present invention is to provide an internal-gear machine which can provide for a reduction in specific bearing loading at the outer periphery of the annular gear as a result of hydraulic forces obtaining in the pressure chamber of the machine.

Still another object of the present invention is to provide an internal-gear machine which, while being of a simple structure, affords satisfactory long-term wearing conditions at its bearing surfaces.

In accordance with the principles of the present invention the foregoing and other objects are attained by an internal-gear machine comprising a casing and a running assembly which is accommodated in the casing. The running assembly comprises a rotatably mounted pinion and an internally toothed annular gear meshing with the pinion. The annular gear is widened at its outer peripheral portion to form a running ring.

As will be seen from preferred embodiments of the invention described in greater detail hereinafter, as the annular gear is wider at its outer periphery than in the region of the tooth configuration thereof, the hydraulic forces which obtain between the co-operating tooth configurations of the pinion and the annular gear and by which the annular gear is pressed into its bearing arrangement are distributed over a larger bearing surface, thereby providing for a reduction in the specific bearing loading, as a result of hydraulic forces prevailing in the pressure chamber. The increase in the width of the annular gear at its outer periphery to constitute a bearing ring can be achieved in a number of different ways. The important consideration is that the part of the annular gear which forms the outer peripheral portion thereof, as a running ring, rotates as a unit together with the part which carries the internal tooth configuration of the annular gear. For that purpose the part of the annular gear which forms the running ring can be integral with the part having the internal tooth configuration, but alternatively the running ring can be a separately produced component which can be joined to the part having the internal tooth configuration, by a connection involving a form-locking or positively locking relationship and/or a force-locking relationship. An adequate force-locking relationship, for example involving frictional engagement, occurs in operation of the internal-gear machine when the part of the annular gear which carries the internal tooth configuration is pressed with its peripheral surface under the effect of the hydraulic forces acting in the tooth configuration against the inner periphery of the running ring. As in operation only the bearing frictional moment has to be overcome in order to cause the running ring to rotate together with the part of the annular gear which carries the internal tooth configuration, the frictional connection which is achieved in that way is sufficient. Therefore, it is also possible to conceive of an embodiment of the invention, for the annular gear which is increased in width at its outer periphery to form a running ring, in which a form-locking connection is afforded between the running ring and the part of the annular gear carrying the internal tooth configuration, only for the time when the internal-gear machine is starting up while still in a pressure-less condition.

Further objects, features and advantages of the invention will be apparent from the following description of preferred embodiments.

DESCRIPTION OF PREFERRED EMBODIMENTS

Figure 1:
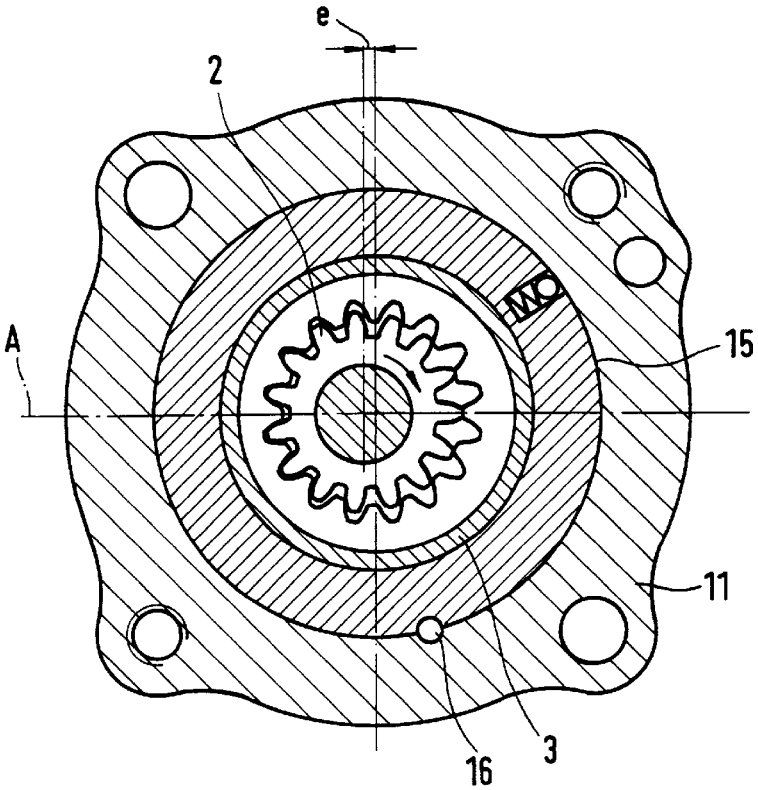
FIG. 1 is a view in cross-section through an embodiment of a filling member-less internal-gear machine taken along line I—I in FIG. 2.
Figure 2:
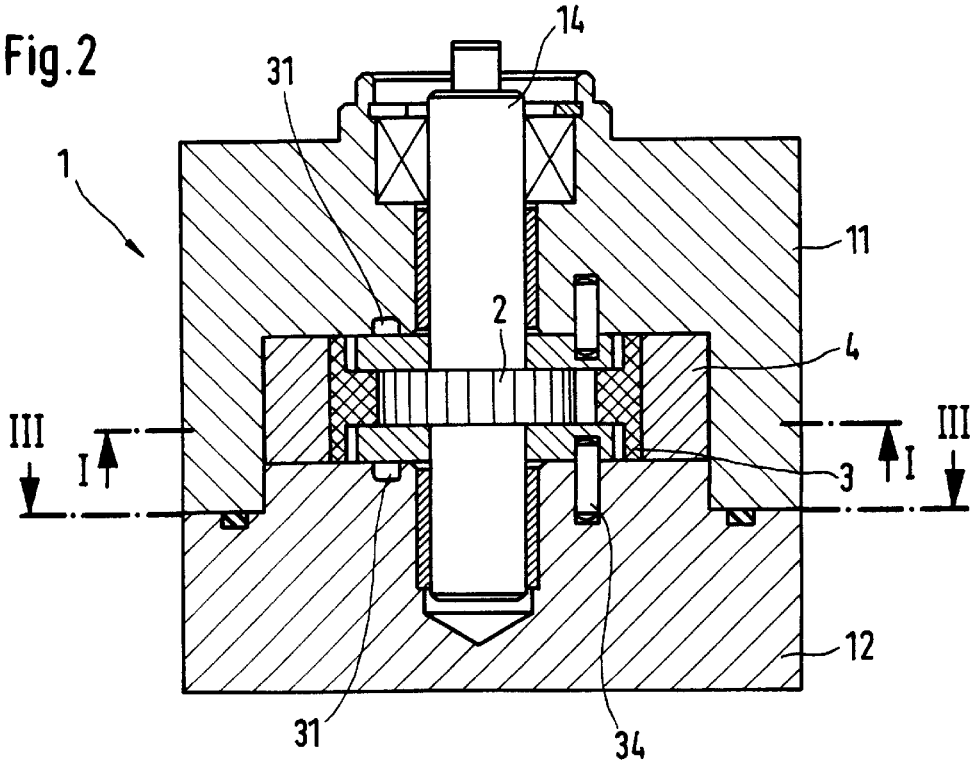
FIG. 2 is a view in axial section taken along line II—II in FIG. 3.
Figure 3:
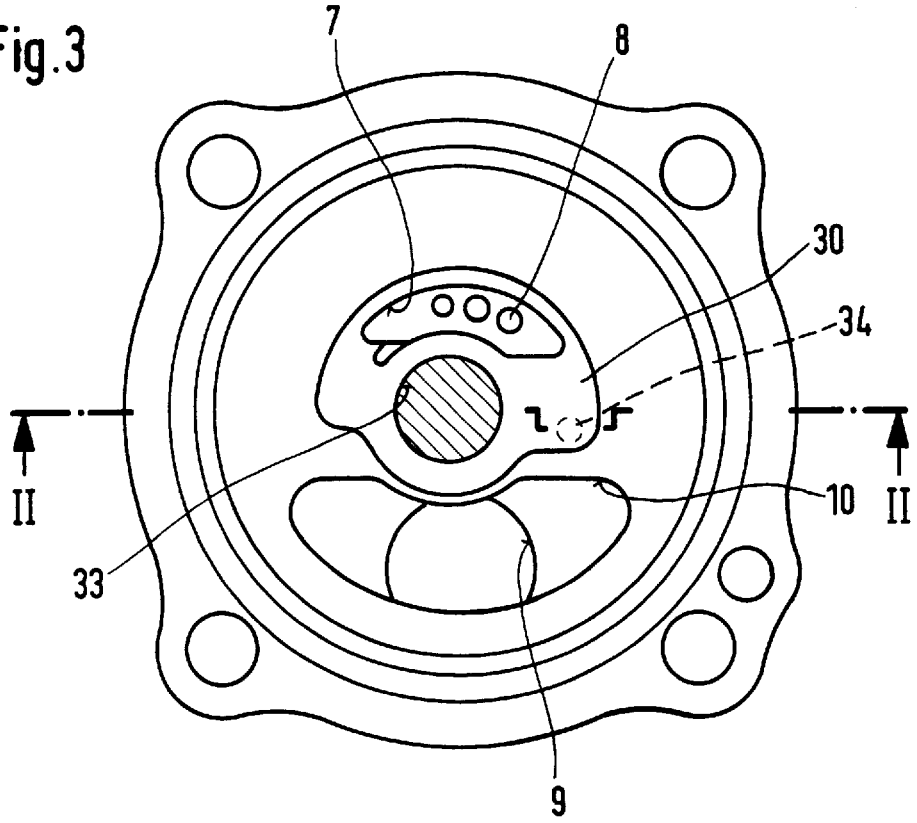
FIG. 3 is a view of the interior of a cover of the casing of the internal-gear machine, viewed in section taken along line III—III in FIG. 2.

Referring firstly to FIGS. 1 through 3, shown therein is an internal-gear machine comprising a casing which is generally identified by reference numeral 1 in FIG. 2 and which is made up of a generally cup-shaped casing portion indicated at 11 in FIGS. 1 and 2 and a casing cover 12 which is fixed to the face of the casing portion 11. Rotatably mounted in the cup-shaped casing portion 11 is a pinion shaft indicated at 14, on which a pinion 2 is non-rotatably mounted. The pinion 2 has external teeth meshing with an internally toothed annular gear 3 which is shown by cross-hatching in FIG. 2 to clearly illustrate it, and which is accommodated in a bearing ring 4 and rotatably supported therein. As can be clearly seen from FIG. 1, the pinion 2 and the annular gear 3 are mounted with a degree of eccentricity indicated at e relative to each other. The eccentricity e, that is to say the spacing between the axis of the pinion 2 and the axis of the annular gear 3, corresponds in this embodiment to the theoretical geometry of the tooth configurations of the pinion 2 and the annular gear 3 and presupposes that the tooth configurations roll or slide against each other in a play-free fashion. The tooth configurations of the pinion 2 and the annular gear 3 mesh with each other in such a fashion that, on the left-hand side in FIG. 1, in the region of a separating line indicated at A, the teeth of the pinion 2 fully engage into the gaps between the teeth of the annular gear 3 and bear against the tooth flanks thereof while, on the opposite side which is therefore at the right in FIG. 1, they have come entirely out of the gaps between the teeth of the annular gear 3. In that region of the annular gear 3, in which there is no tooth engagement with the pinion 2, a plurality of the tips of the teeth of the pinion 2 and the annular gear 3 are successively supported against each other in the course of the rotary movement. In the illustrated structure, it will be seen that there are three tooth tips in each case which are in contact with each other. The number of teeth and the geometry of the mutually meshing tooth arrangements on the pinion 2 and the annular gear 3 are so selected that this kind of meshing engagement can be implemented in the usual fashion involved in an internal-gear machine. This is an aspect which is familiar to the persons skilled in the art in this respect and there is therefore no need for a more detailed discussion in this respect herein.

In the illustrated embodiment the tooth flanks are in the form of involute curves, wherein the tips of the teeth are rounded off to achieve satisfactory rolling and sliding contact, for the purposes of affording a sealing effect. In this embodiment the number of teeth of the annular gear 3 differs from the number of teeth on the pinion 2 by one.

Upon rotary movement of the pinion 2 in the direction indicated by the arrow in FIG. 1, the illustrated structure involves an increase in the size of the space, which becomes free, in the gap between adjacent teeth, starting from the condition of full engagement of the tooth arrangement of the pinion 2 into the tooth arrangement of the annular gear 3, over the separation line A, with a progressive increase until the condition shown in FIG. 1 is attained at which the co-operating teeth again pass across the separating line A, at the right-hand side in FIG. 1. As a result, the suction chamber of the internal-gear machine is formed above the separating line A while below the separating line A, the free space afforded by a gap between adjacent teeth is again progressively reduced in size, so that the pressure chamber of the machine is formed thereby.

The bearing ring 4 is accommodated in a bore 15 in the casing portion 11, with a radial play or clearance of about 0.2 mm. A bearing pin 16 which is fixedly pressed into the bottom of the bore 15 in the casing partially passes through the wall of the bore 15. The substantially semi-cylindrical part of the pin 16, which projects beyond the surface of the wall of the bore 15, is accommodated in an axially directed groove (shown but not illustrated) in the bearing ring 4. The axial groove is matched to the shape of the pin 16 and is therefore also partially cylindrical. Accordingly, the pin 16 which engages into the axial groove forms for the bearing ring 4 a pivot axis which extends parallel to the axes of the pinion 2 and the annular gear 3 and about which the bearing ring 4 is pivotable in the casing bore 15 within the limits of the radial play or clearance available. As can be seen from FIG. 1 that pivot axis is disposed in a quadrant of the bearing ring 4 which extends between the tooth engagement-free region of the annular gear 4, and the center of the pressure chamber. That structure affords the usual mode of operation of the internal-gear machine illustrated in this embodiment, in that the pressure forces obtaining in the pressure chamber give rise to a torque about the pin 16, by virtue of which the bearing ring 4 is pivoted about the pivot axis formed by the pin 16. As a result, in the tooth engagement-free region of the annular gear 3, the tips of the teeth of the pinion 2 and the annular gear 3 are moved towards each other by a force which is proportional to the magnitude of the pressure forces, and they are held in sealing contact with each other. Attention may be directed in this respect for further information to DE 196 51 683 A1 and corresponding U.S. Pat. No. 6,074,189 (U.S. Ser. No. 08/987,001).

In the embodiment shown in FIGS. 1 through 3 the pinion shaft 14 is supported both in the casing portion 11 and also in the casing cover 12 by way of bearing bushes. As can be seen from FIG. 2 the width of the bearing ring 4 exceeds the width of the pinion 2 and the annular gear 3 by a considerable amount and bears with its end faces displaceably against the adjoining wall surfaces of the casing portion 11 and the cover 12. In contrast, a respective axial plate 30, the shape of which can be more particularly seen from FIG. 3, bears sealingly against the faces of the tooth arrangements of the pinion 2 and the annular gear 3 at respective sides thereof. On its surface towards the respective tooth arrangements, each of the two axial plates 30 has a pressure area or field which is indicated at 7 in FIG. 3 and in the region of which three openings 8 are provided in the axial plate 30 which is arranged on the side of the casing cover 12. The openings 8 lead from the pressure chamber to a pressure outlet duct (not shown) in the casing cover 12. In diametrally opposite relationship to the pressure outlet duct the casing cover 12 has a suction inlet duct 9 which is enlarged at its mouth opening to form a suction area or field indicated at 10 in FIG. 3. Indicated in each of the wall surfaces of the casing portion 11 and the casing cover 12 in FIG. 2 is a respective pressure area or field 31, by which the respective axial plate 30 is acted upon from the exterior against the action of the inner pressure area 7, in such a way that the axial plate 30 remains in sealing contact with the pinion 2 and the annular gear 3, in all operating conditions of the machine. The design configuration and the mode of operation of the pressure areas on axial plates of that kind are familiar to the persons skilled in the art in this respect and therefore do not need to be described in greater detail herein.

For the purposes of being suitably secured in position, each axial plate 30 bears on the one hand by way of the periphery of a mounting bore indicated at 33 in FIG. 3 on the pinion shaft 14 and on the other hand on a pin which is indicated at 34 in FIG. 3 and which is fitted into the casing portion 11 and the casing cover 12 respectively. The pins 34, as can be clearly seen from FIG. 2, each project into a blind bore in the outer face of the respective axial plates 30 and are thereby axially held in position. Instead of the axial plates 30 being fixed to the casing by means of the pins 34, it is also possible to envisage alternative structures which permit a movement of the axial plates 30 together with the pinion 2, the annular gear 3 and the bearing ring 4, in which respect attention may be directed to EP 97-121424.2 A1 for further information in this respect, the disclosure thereof hereby being incorporated into this specification by virtue of reference thereto.

Figure 4:
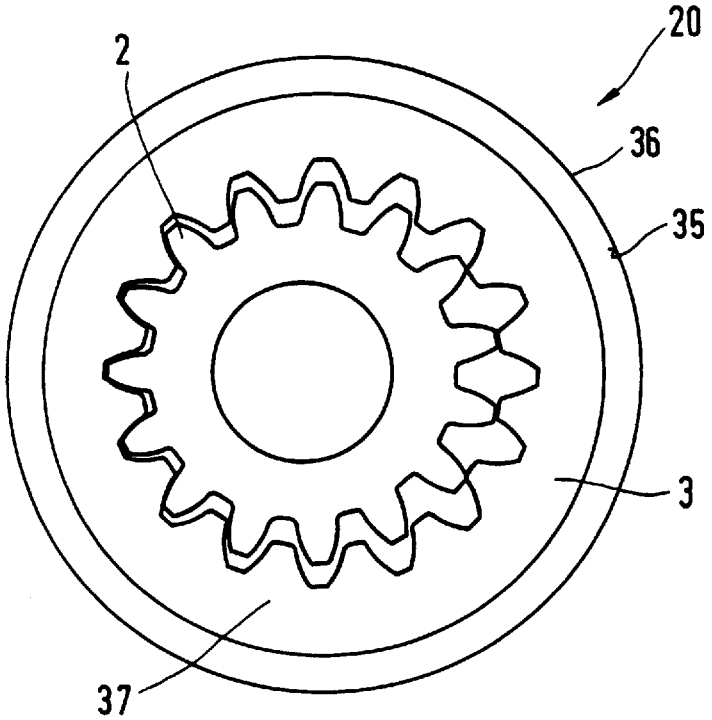
FIG. 4 is an end view of the running assembly comprising the annular gear and the pinion, which is used in the internal-gear machine shown in FIGS. 1 through 3, FIGS. 5*a* through 5*f* show six different alternative configurations of the annular gear with an outer peripheral surface which is increased in width to constitute a running ring, in an axial section through the running assembly shown in FIG. 4.

Reference will now be made to FIG. 4 showing a running unit or assembly 20 which is used in the internal-gear machine illustrated in FIGS. 1 through 3 and which comprises the pinion 2 and the annular gear 3. The annular gear 3 has an outer portion which is increased in width in relation to the remainder of the annular gear 3 to constitute a running ring indicated generally at 35, forming the outer periphery 36 of the annular gear 3, and a part 37 which carries the internal tooth arrangement of the annular gear 3. As can be seen from FIG. 2, the running ring 35 of the annular gear considerably extends beyond the width of the part 37 carrying the internal tooth arrangement; in this embodiment, the width of the running ring 35 is approximately three times the width of the internally toothed part 37. As a result, the annular gear 3 is supported in the correspondingly widened bearing ring 4 in which it is slidingly accommodated, under such a low specific bearing pressure that the pressure forces involved, that is to say the conveying pressure or the operating pressure, in the pressure chamber, can be fixed from the outset by virtue of the structure according to the invention, without consideration being given to the admissible load-bearing capability of the plain bearing assembly.

In order to ensure rotational movement of the annular gear 3 in the plain bearing assembly, more specifically in this case in the bearing ring 4, in its entirety, the internally toothed part 37 is non-rotatably connected to the running ring 35.

Figure 5A:
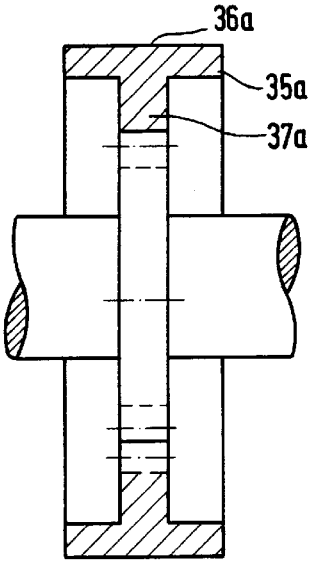

FIGS. 5*a* through 5*f* show various different forms of suitable ways of connecting those two components, the structure shown in FIG. 5*a* involving the running ring 35*a* and the internally toothed part 37*a* being of an integral construction. This embodiment makes it possible to produce the outer peripheral surface 36*a* and the internal tooth arrangement in one chucking procedure.

Figure 5B:
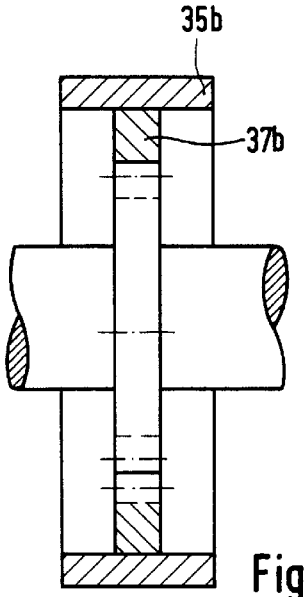
Figure 5C:
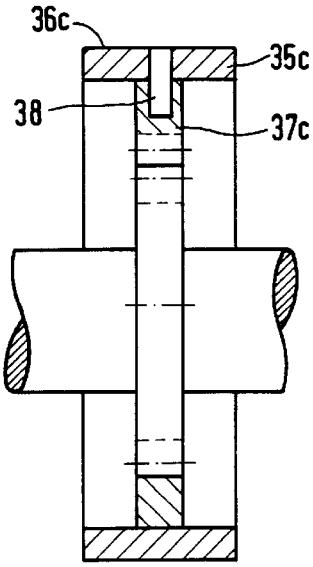

In the structure shown in FIG. 5*b*, the running ring 35*b* and the internally toothed part 37*b* form separate components which are connected together by a suitable procedure such as pressing, shrinking or glueing. This embodiment makes it possible to choose different materials for the running ring and the internally toothed part 37*b*. and that makes it possible to adapt the structure better to the required bearing and meshing properties respectively.

Figure 5D:
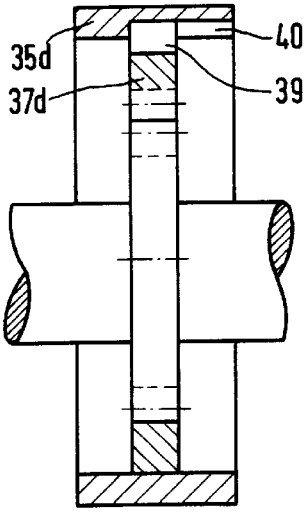
Figure 5E:
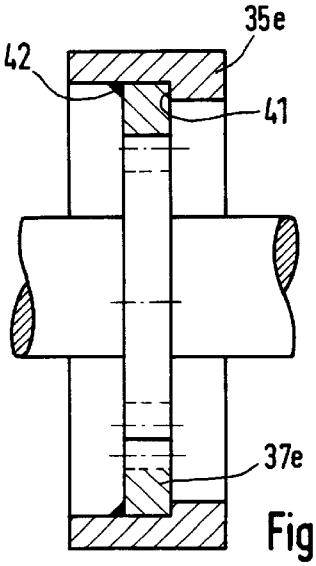
Figure 5F:
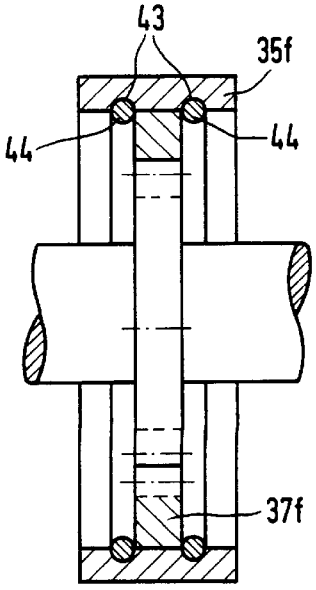

In the alternative structures shown in FIGS. 5*c* through 5*f*, the bearing ring and the internally toothed part of the annular gear are also separate components. The structure shown in FIG. 5*c* has a positively locking connection between the running ring 35*c* and the internally toothed part 37*c* by means of a pin 38 which is pressed radially from the outer periphery 36*c* into the internally toothed part 37*c*. The structure of FIG. 5*d* provides that the internally toothed part 37*d* is connected to the running ring 35*d* by a cylindrical pin 39 which is pressed in axially and which fits in a correspondingly part-cylindrical groove 40 in the bearing ring 35*d* and a groove (not identified), which is also part-cylindrical. in the internally toothed part 37*d*. In the alternative structure shown in FIG. 5*e* the inner periphery of the bearing ring 35*e* has a shoulder 41 against which the internally toothed part 37*e* bears with its face at its peripheral edge portion and is fixed in position by a spot weld or a weld seam 42 which extends partially or entirely around the assembly. In the embodiment shown in FIG. 5*f* the inner periphery of the running ring 35*f* has two annular grooves 43 which are arranged at an axial spacing from each other and into each of which a respective spring ring 44 is fitted by a spring action. The mutually facing edges of the annular grooves 43 are at a spacing from each other which corresponds at most to the width of the internally toothed part 37*f*. thereby ensuring that the spring rings 44 bear in frictional engagement against the adjoining peripheral edge portions of the internally toothed part 37*f* and thereby hold same in position.

Figure 6:
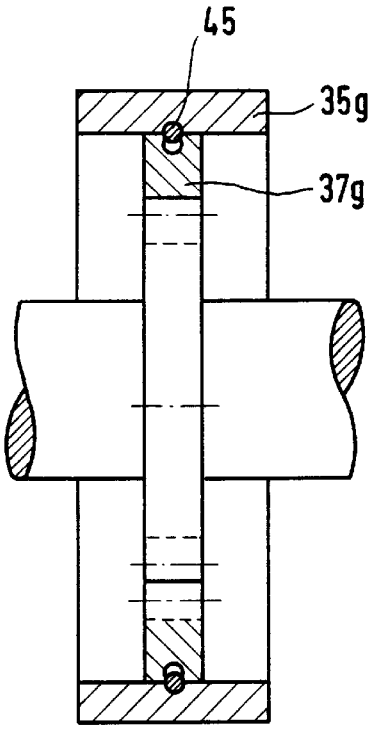
FIG. 6 is a view in axial section similar to FIG. 5 through a further modified embodiment of the running assembly.
Figure 7:
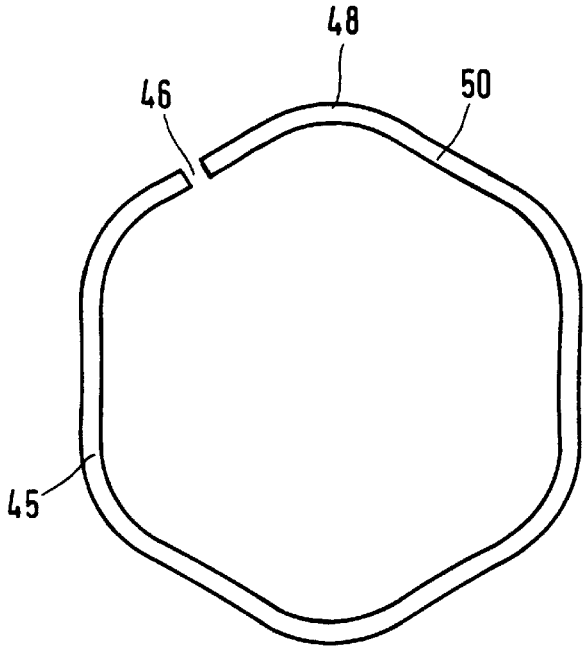
FIG. 7 shows a spring ring which is used in the running assembly illustrated in FIG. 6.
Figure 8:
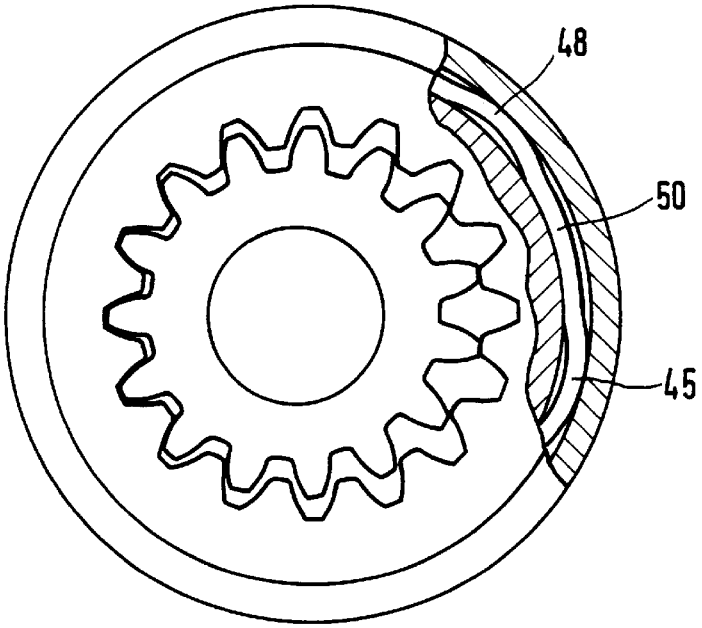
FIG. 8 is a partly sectional front view of the running assembly shown in FIG. 6, and FIGS. 9 and 10 are a view in axial section and a front view of an embodiment of the running assembly in which the annular gear is carried by way of a rolling bearing arrangement in a bearing ring in the casing.

Referring now to FIGS. 6 through 8, in the embodiment illustrated therein the widened running ring 35*g* is coupled to the internally toothed part 37*g* of the annular gear 3 by way of at least one spring ring of which one is indicated at 45 and the shape of which can be seen from FIG. 7. For that purpose, the running ring 35*g* has a peripherally extending annular groove at its inner periphery and the internally toothed part 37*g* has a peripherally extending annular groove at its outer periphery, with the spring ring 45 being accommodated in the respective grooves. The polygonal configuration of the spring ring 45 which in the illustrated embodiment is generally hexagonal but which can also be triangular or of other polygonal configuration and which moreover is interrupted by a gap indicated at 46 means that the spring ring 45 has six outward bulge portions 48 which are connected together by intermediate portions 50 which extend generally straight. The portions 50 can also be adapted to the curvature of the outer periphery of the internally toothed part 37*g* of the annular gear 3, in the region of the bottom of the groove accommodating same, or they can even be curved inwardly, that is to say towards the bottom of the groove, in opposite relationship to the bulge portions 48.

In the installed condition the spring ring 45 bears with its bulge portions 48 in a condition of frictional engagement in the groove against the inner periphery of the running ring 35*g* while its connecting portions 50 are urged by a spring prestressing force with frictional engagement into the annular groove at the outer periphery of the internally toothed part 37*g*, in a manner which can be most clearly seen from FIG. 8.

It will be noted that, in the structures shown in FIG. 5*f* and FIGS. 6 through 8 the running ring is connected to the internally toothed part of the annular gear 3 only by way of frictional engagement, that is to say by a force-locking connection in this case. In that respect, the internally toothed part of the annular gear 3 can be inserted with a sliding fit into the running ring so that the force-locking connection is ensured solely by virtue of the spring rings in the start-up condition of the internal-gear machine, being therefore a condition in which the machine is still substantially pressure-less. As soon as the conveying or operating pressure has then built up in operation in the pressure chamber defined by the tooth configurations of the pinion 2 and the annular gear 3, the internally toothed part of the annular gear is pressed against the running ring within the limits of the clearance made available by virtue of the sliding fit, and that therefore ensures that, even with the increased frictional moment in the support for the annular gear, it still rotates in its entirety.

Figure 9:
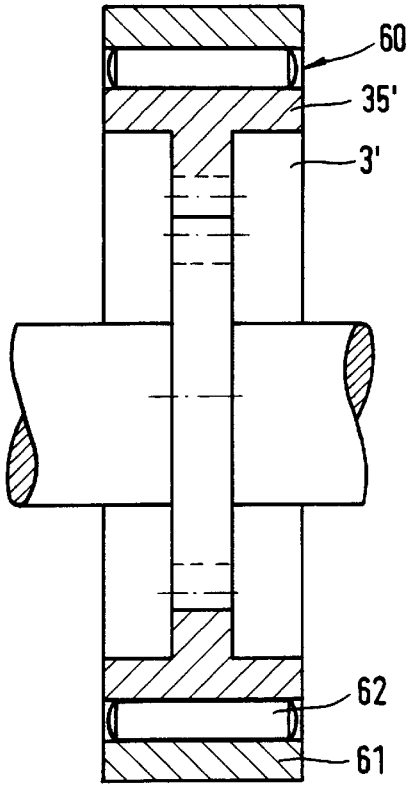
Figure 10:
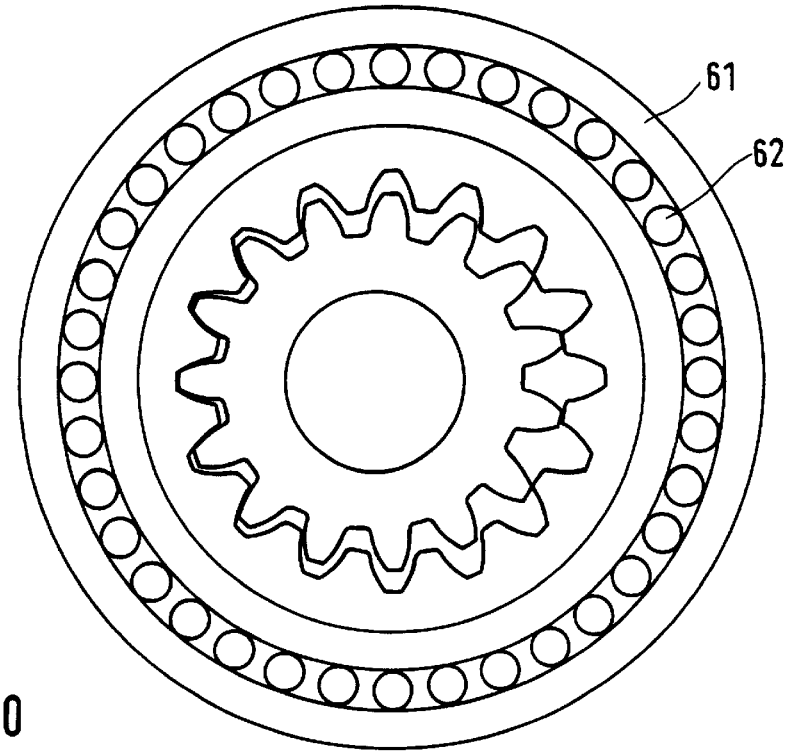

Looking now at FIGS. 9 and 10, the embodiment of the annular gear shown therein corresponds to that of the structure shown in FIG. 5*a*, in which the running ring and the internally toothed part of the annular gear are an integral component. In the embodiment described here however the annular gear 3' is accommodated with its increased-width outer peripheral portion by way of a rolling bearing arrangement 60 in a bearing ring 61 which can be arranged pivotably in the casing, by way of a mounting pin, as in the case of the embodiment shown in FIGS. 1 through 3. The rolling bearing arrangement 60 is formed here by a plurality of bearing needles 62, the length of which is matched to the width of the bearing ring 35'.

It will be appreciated that the above-described embodiments of the present invention have been set forth solely by way of example and illustration of the principles of the invention and that various other modifications and alterations may be made therein without thereby departing from the spirit and scope of the invention.

Thus for example the running ring formed by the annular gear being increased in width in the region of its outer peripheral portion does not necessarily have to be symmetrical with respect to the central plane of the tooth arrangement thereof, but it can also project only beyond the plane of one side face of the annular gear. Furthermore, in an embodiment of the internal-gear machine according to the invention in which the annular gear is coupled at its outer periphery by way of sealing elements to a rotating running ring, in which respect attention may be directed to EP 0 789 814 A1 for further information in this respect, that running ring can be considered as part of the annular gear, which can be increased in width in relation to the internally toothed part of the annular gear in order to reduce the bearing loading.

What is claimed is:

1. An internal-gear machine comprising:

a casing, and a running assembly accommodated in the casing, the running assembly comprising a pinion having external teeth, means for rotatably mounting the pinion in the casing, an annular gear and bearing means for rotatably mounting the annular gear in the casing, wherein the annular gear includes an internally toothed part meshing with the external teeth of the pinion and a running ring fixedly mounted on an outer periphery of the internally toothed part so that the running ring and the internally toothed part rotate together, the running ring being wider in the axial direction than the internally toothed part and supporting the annular gear in the bearing means.

2. An internal-gear machine as set forth in claim 1 wherein the running ring is connected in positively locking relationship to the internally toothed part of the annular gear.

3. An internal-gear machine as set forth in claim 2 wherein the running ring is connected to the internally toothed part of the annular gear by at least one pin.

4. An internal-gear machine as set forth in claim 1 wherein the running ring is connected to the internally toothed part of the annular gear in force-locking relationship.

5. An internal-gear machine as set forth in claim 4 including at least one spring ring with outward bulge means, disposed around the periphery of the internally toothed part and bearing resiliently against the inner periphery of the running ring, thereby to connect the running ring to the internally toothed part of the annular gear in said force-locking relationship.

6. An internal-gear machine as set forth in claim 5 including a groove in the outer periphery of said internally toothed part receiving said spring ring.

7. An internal-gear machine as set forth in claim 5 including a groove in the inner periphery of the running ring receiving said spring ring.

8. An internal-gear machine as set forth in claim 4 including grooves at the inner periphery of the running ring, and first and second spring rings received in the grooves and bearing against the faces of said internally toothed part to hold said part between said spring rings.

9. An internal-gear machine as set forth in claim 4, wherein the internally toothed part is press-fitted into the running ring.

10. An internal-gear machine as set forth in claim 4, wherein the internally toothed part is shrink-fitted into the running ring.

11. An internal-gear machine as set forth in claim 4, wherein the internally toothed part is glued into the running ring.

12. An internal-gear machine as set forth in claim 1 wherein the running assembly is without a filling member, and further including a bearing ring which is arranged non-rotatably in the casing and in which the annular gear is mounted rotatably.

13. An internal-gear machine as set forth in claim 1 wherein the casing has a bore and the annular gear is mounted to rotate in the bore in the casing.

14. An internal-gear machine as set forth in claim 1 including a filling member separating a pressure chamber formed between the tooth configurations of the running assembly from a suction chamber.

15. An internal-gear machine as set forth in claim 1 and including a plain bearing supporting the annular gear by way of its outer periphery.

16. An internal-gear machine as set forth in claim 1 and including a rolling bearing supporting the annular gear by way of its outer periphery.

17. An internal-gear machine as set forth in claim 1 wherein the running ring projects axially beyond at least one of the end faces of the annular gear.

18. An internal-gear machine as set forth in claim 1 including an axial plate bearing in sealing relationship against at least one end face of the annular gear, covering over the tooth configurations of the pinion and the annular gear, at least in a pressure chamber region, wherein the face of the running ring which is associated with the axial plate and the axial outside surface of the axial plate lie in one plane.

19. An internal-gear machine comprising:

a casing, a bearing ring in the casing, an annular gear rotatably mounted in the bearing ring, the annular gear comprising an internally toothed part and a running ring fixedly mounted on an outer periphery of the internally toothed part so that the running ring and the internally toothed part rotate together, the running ring being wider in the axial direction than the internally toothed part and cooperating with the bearing ring, a pinion, means rotatably mounting the pinion in the casing, the pinion having teeth meshing with the annular gear and defining a suction chamber and a pressure chamber of the tooth arrangement by full engagement into gaps between the teeth of the annular gear on the one hand and sealing contact with the tips of the teeth of the annular gear in an engagement-free annular gear region which is approximately diametrically opposite the engagement into the gaps between the teeth on the other hand.

20. An internal-gear machine as set forth in claim 19, wherein the internally toothed part is press-fitted into the running ring.

21. An internal-gear machine as set forth in claim 19, wherein the internally toothed part is shrink-fitted into the running ring.

22. An internal-gear machine as set forth in claim 19, wherein the internally toothed part is glued into the running ring.

* * * * *